US012409975B2

(12) United States Patent
Inoue et al.

(10) Patent No.: US 12,409,975 B2
(45) Date of Patent: Sep. 9, 2025

(54) PACKAGING STRUCTURE

(71) Applicant: MABUCHI MOTOR CO., LTD., Chiba (JP)

(72) Inventors: Kunio Inoue, Chiba (JP); Ryo Okuyama, Chiba (JP); Teruhisa Obata, Chiba (JP); Hiroki Kouno, Chiba (JP)

(73) Assignee: MABUCHI MOTOR CO., LTD., Chiba (JP)

( * ) Notice: Subject to any disclaimer, the term of this patent is extended or adjusted under 35 U.S.C. 154(b) by 125 days.

(21) Appl. No.: 18/457,340

(22) Filed: Aug. 29, 2023

(65) Prior Publication Data

US 2024/0083633 A1 Mar. 14, 2024

(30) Foreign Application Priority Data

Sep. 9, 2022 (JP) ..... 2022-143547
Apr. 25, 2023 (JP) ..... 2023-071182

(51) Int. Cl.
*B65D 25/10* (2006.01)
*B65D 5/50* (2006.01)
*B65D 85/68* (2006.01)

(52) U.S. Cl.
CPC ..... *B65D 25/108* (2013.01); *B65D 5/5038* (2013.01); *B65D 85/68* (2013.01); *B65D 2585/6877* (2013.01)

(58) Field of Classification Search
CPC ..... B65D 5/50; B65D 5/5038; B65D 25/10; B65D 25/108; B65D 85/68; B65D 2585/6877
USPC ..... 206/526, 562–563, 763–765
See application file for complete search history.

(56) References Cited

U.S. PATENT DOCUMENTS 4,098,400 A * 7/1978 Brown ..... B65D 71/70 206/319
5,794,783 A * 8/1998 Carter ..... H01L 21/67333 206/562
5,934,471 A * 8/1999 Jun ..... B65D 71/70 206/509

FOREIGN PATENT DOCUMENTS

CN 212710624 U * 3/2021
JP 2913259 B2 6/1999
JP 2015187007 A 10/2015

OTHER PUBLICATIONS

Transformer Packaging Structure (Year: 2021).*

* cited by examiner

*Primary Examiner* — Bryon P Gehman
(74) *Attorney, Agent, or Firm* — HAUPTMAN HAM, LLP

(57) ABSTRACT

A packaging structure disclosed herein includes a box in which a component is accommodated and a lower layer tray and a middle layer tray formed of a cardboard sheet. The lower layer tray is provided inside the box. The middle layer tray is provided above the lower layer tray inside the box. The lower layer tray includes a lower layer opening into which the component is inserted and fixed, and a lower layer first tab provided at an edge of the lower layer opening and folded downward. The middle layer tray includes a middle layer opening into which the component is inserted and fixed, and a middle layer first tab provided at an edge of the middle layer opening, folded downward, and engaged with the lower layer opening in a state of overlapping the lower layer first tab.

17 Claims, 7 Drawing Sheets

Developed view of lower layer tray

Developed view of middle layer tray (A)

(B)

PACKAGING STRUCTURE

RELATED APPLICATIONS

The present application claims priority to Japanese Application No. 2022-143547 filed Sep. 9, 2022, and Japanese Application No. 2023-071182 filed Apr. 25, 2023, the disclosures of which are hereby incorporated by reference herein in their entirety.

BACKGROUND

Technical Field

The present disclosure relates to a packaging structure for a component.

Related Art

Conventionally, when a component manufactured in a factory or a manufactory is conveyed to a warehouse, an outside area, or the like, a packaging box for housing the component is used. A protection structure for protecting a component from vibration or impact during conveyance while stably holding the component is provided inside a general packaging box. As specific examples of the protection structure, a vertical partition structure in which a plurality of corrugated cardboard plates is combined in a grid pattern, a rectangular tube structure in which one sheet of cardboard is bent into a tubular shape, and the like are known (See, for example, JP-B2-2913259 and JP-A-2015-187007.).

SUMMARY

In the conventional vertical partition structure, it is necessary to engage the slits of the plurality of corrugated cardboard plates with each other and combine them in a grid pattern, and labor and time required for preparation of packaging work are likely to increase. Furthermore, the same applies to the conventional rectangular tube structure, and a part of the cardboard bent into a tubular shape needs to be inserted into a slit-shaped gap to penetrate the slit-shaped gap, and there is room for improving workability. On the other hand, in a case where the protection structure is unintentionally simplified in order to improve workability, for example, by reducing the number of corrugated cardboard plates constituting the vertical partition structure or reducing the number of insertion places in the rectangular tube structure, the protection of the parts may be deteriorated.

One of the objects of the present disclosure is to provide a packaging structure that has been created in light of the above problems and is capable of enhancing workability related to packaging while securing protection for components. It is to be noted that the present disclosure is not limited to this object, and it is also possible to position, as another object of the present disclosure, an effect that is derived from each configuration shown in "DETAILED DESCRIPTION" to be described later and cannot be obtained by conventional techniques.

The packaging structure disclosed herein includes: a box in which a component is accommodated; a lower layer tray formed of a cardboard sheet and provided inside the box; and a middle layer tray formed of a cardboard sheet and provided above the lower layer tray inside the box. The lower layer tray includes a lower layer opening into which the component is inserted and fixed, and a lower layer first tab provided at an edge of the lower layer opening and folded downward. The middle layer tray includes a middle layer opening into which the component is inserted and fixed, and a middle layer first tab provided at an edge of the middle layer opening, folded downward, and engaged with the lower layer opening in a state of overlapping the lower layer first tab.

According to the disclosed packaging structure, the lower layer tray and the middle layer tray can be firmly engaged with each other with a simple configuration, and workability of packaging work can be enhanced while securing protection for components.

DETAILED DESCRIPTION

The disclosed packaging structure may be implemented by the following examples (embodiments). This packaging structure is a packaging structure for a component. The type of the component is not limited, and various motors are included, for example. In the following embodiments, it is assumed that a specific example of the component is a motor 4 with a decelerator.

Embodiments

1. Configuration

Figure 1:
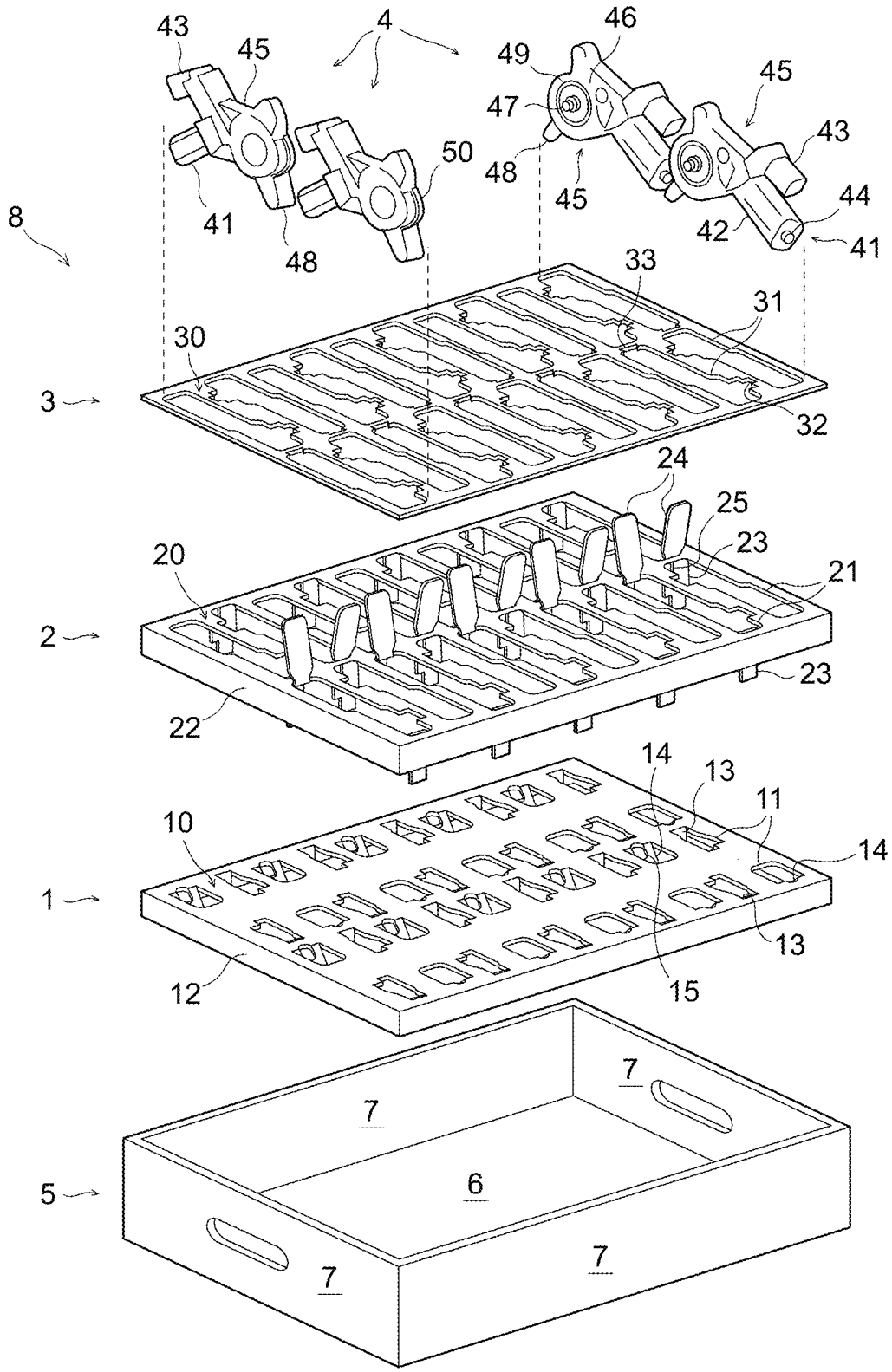
FIG. 1 is an exploded perspective view for explaining a packaging structure as an embodiment.

FIG. 1 is an exploded perspective view illustrating a packaging structure 8 and a motor 4 (an example of a component according to the packaging structure 8) as an example. The motor 4 is, for example, a small DC motor with a decelerator used as a drive source for in-vehicle electrical equipment, industrial machines, precision equipment, office equipment, home appliances, tools, toys, models, and the like. The motor 4 includes a motor unit 41 and a decelerator unit 45.

The motor unit 41 has a structure in which a rotor and a stator (not illustrated) are incorporated in a motor housing 42. A connector portion 43 for connecting a wire harness is provided in the vicinity of the motor unit 41. Power and a control signal for rotationally driving the rotor are input to the motor unit 41 via the wire harness. Furthermore, the motor housing 42 is provided with a protrusion 44 in a protruding manner. The protrusion 44 is a portion in which a shaft end portion of the rotor or a bearing (bearing rotatably supporting a shaft with respect to the motor housing 42) is incorporated, and is a portion protruding in a columnar shape toward the outside of the motor housing 42.

The decelerator unit 45 has a structure in which a deceleration mechanism (not illustrated) is incorporated in a decelerator case 46. The rotational motion of the rotor generated by the motor unit 41 is decelerated via the deceleration mechanism and then output from an output shaft 47 connected to the deceleration mechanism to the outside of the motor 4. Note that in a case where the deceleration mechanism is configured by a combination of a worm and a helical gear (worm wheel), the output shaft 47 is fixed to the helical gear so as to be coaxial with a rotation shaft of the helical gear.

In the example illustrated in FIG. 1, the output shaft 47 is provided so as to pass through a center of a round hole drilled at a position where a top surface of the hollow cylindrical decelerator case 46 and a cylinder axis intersect. A packing 49 is attached to the top surface of the decelerator case 46 so as to surround the periphery of the output shaft 47. The packing 49 is a member for sealing a gap between the motor 4 and an object to which the motor 4 is mounted. Furthermore, on a cylindrical surface of the hollow cylindrical decelerator case 46, a mounting foot 48 is bulged and a cover portion 50 is provided in a protruding manner. The mounting foot 48 is a boss-shaped portion to which a fixture (bolts, nuts, screws, rivets, clips, or the like) for fixing the motor 4 to an object to be mounted is attached. Furthermore, the cover portion 50 corresponds to a joint portion between a lid member of the decelerator case 46 and a container body, and is formed in a shape in which a ring-shaped region that is a part of the cylindrical surface of the decelerator case 46 protrudes radially outward.

The packaging structure 8 illustrated in FIG. 1 includes a middle box 5 (box) in which the motor 4 is accommodated, a lower layer tray 1, a middle layer tray 2, and an upper layer tray 3. The lower layer tray 1, the middle layer tray 2, and the upper layer tray 3 are buffer members for suppressing rattling and movement of the motor 4 at the time of conveying the middle box 5 accommodating the motor 4 and alleviating an external force that can act on the motor 4, and are formed of a cardboard sheet. The cardboard sheet here includes paper cardboard, plastic cardboard, and the like formed in a sheet shape. Furthermore, the middle box 5 may be formed of a material that improves the weight and shape stability of the entire package when the motor 4 is conveyed, and may be formed of, for example, a cardboard sheet or another material.

The middle box 5 is a flat rectangular parallelepiped container (drawer-like interior box, carton) whose upper surface is opened. The middle box 5 has a bottom surface 6 and four side surfaces 7 erected upward from four outer peripheral sides surrounding the bottom surface 6. A plurality of the motors 4 can be accommodated in one middle box 5. The middle box 5 illustrated in FIG. 1 can accommodate 20 motors 4. The middle box 5 in which the motor 4 is accommodated is conveyed in a state of being regularly packed in, for example, an outer box (not illustrated) larger in size than the middle box 5. Note that, in consideration of ease of carrying the middle box 5 by hand, handling holes may be formed in a pair of opposing side surfaces 7.

[A. Lower Layer Tray]

Figure 2:
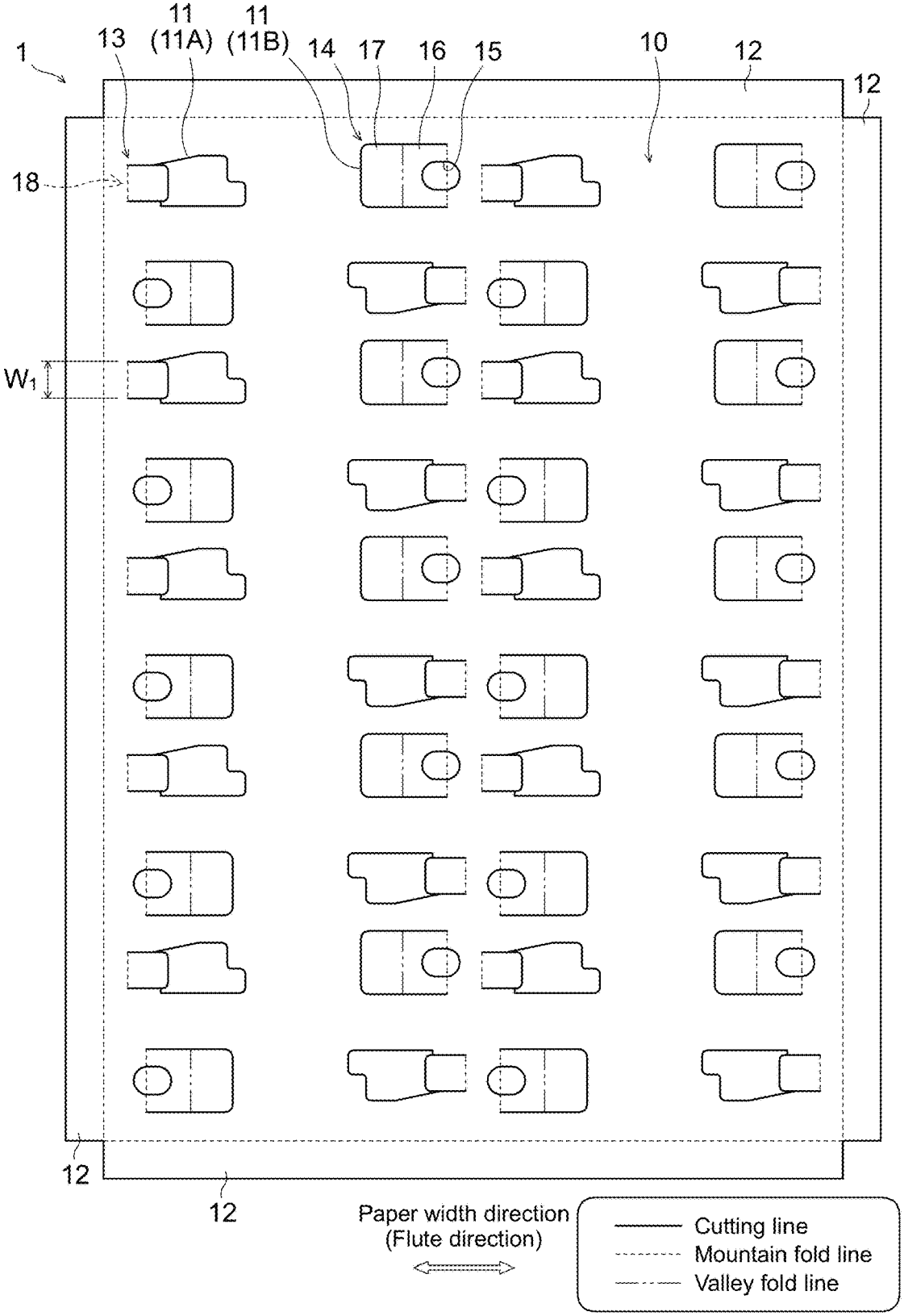
FIG. 2 is a developed view of a lower layer tray illustrated in FIG. 1.

The lower layer tray 1 is a tray-shaped (alternatively, a planar shape or a tray shape) member provided inside the middle box 5. The lower layer tray 1 of the present embodiment is laid in a substantially horizontal state (so as to be substantially parallel to the bottom surface 6) inside the middle box 5. Here, a developed view of the lower layer tray 1 is illustrated in FIG. 2. A solid line in FIG. 2 represents a cutting line. Furthermore, a broken line in FIG. 2 represents a mountain fold line when the lower layer tray 1 is viewed from above, and a two-dot chain line in FIG. 2 represents a valley fold line when the lower layer tray 1 is viewed from above. A paper width direction (flute direction, direction in which a hollow portion of a center core extends) of the cardboard sheet constituting the lower layer tray 1 is the left-right direction in FIG. 2. Furthermore, an enlarged perspective view of a state in which the mountain fold line and the valley fold line are folded is illustrated in FIG. 5.

Figure 5:
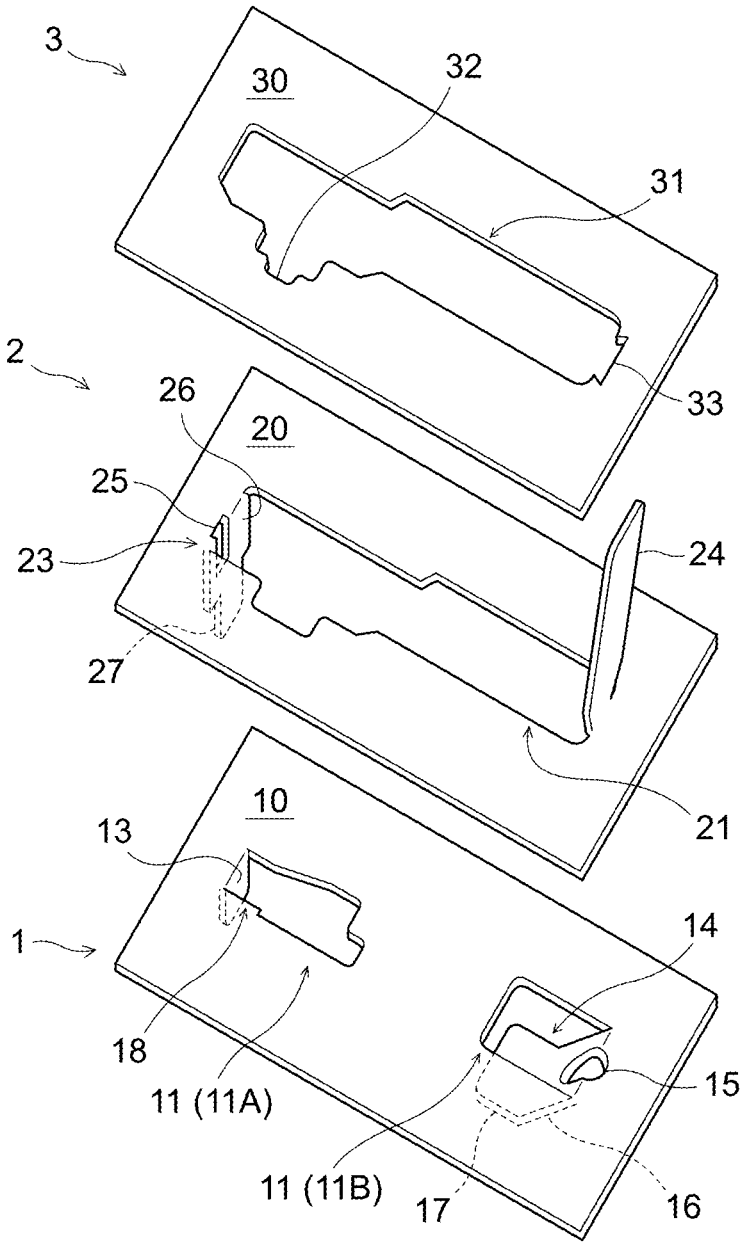
FIG. 5 is an enlarged exploded perspective view illustrating a structure for supporting one component (motor)

As illustrated in FIGS. 1, 2, and 5, the lower layer tray 1 is provided with a lower layer upper surface portion 10, a lower layer opening 11, a lower layer leg 12, a lower layer first tab 13, a lower layer second tab 14, and a lower layer holding hole 15. In the lower layer tray 1 illustrated in FIG. 2, the motors 4 are accommodated in an arrangement of two rows horizontally and ten lines vertically such that a longitudinal direction of each of the motors 4 is parallel to the paper width direction of the cardboard sheet. Two lower layer openings 11, one lower layer first tab 13, and one lower layer second tab 14 are provided in a place where one motor 4 is accommodated. Furthermore, the lower layer second tab 14 is provided with a lower layer longitudinal portion 16 and a lower layer lateral portion 17, and a lower layer locking portion 18 is provided in a portion of the lower layer opening 11 where the lower layer first tab 13 is folded. Note that the number of rows in an array layout of the motors 4 can be set as a plurality of rows of two or more rows (for example, three rows, five rows, ten rows, or the like). The same applies to the number of lines, and the number of lines can be set as a plurality of lines of two or more lines (for example, two lines, three lines, five lines, or the like).

With respect to the layout of the cutting line, the mountain folding line, and the valley folding line illustrated in FIG. 2 in which two rows are arranged horizontally and ten lines are arranged vertically, the layout shape of the first row from the left is a congruent shape in which the layout shape of the second row is directly translated in the left-right direction in FIG. 2. Furthermore, the layout shape of the odd-numbered line from the top is a rotationally symmetric shape obtained by rotating the layout shape of the even-numbered line by 180° in the plane of paper of FIG. 2. With such a layout shape, the motor 4 is efficiently accommodated in a limited space in the middle box 5.

Figure 6A:
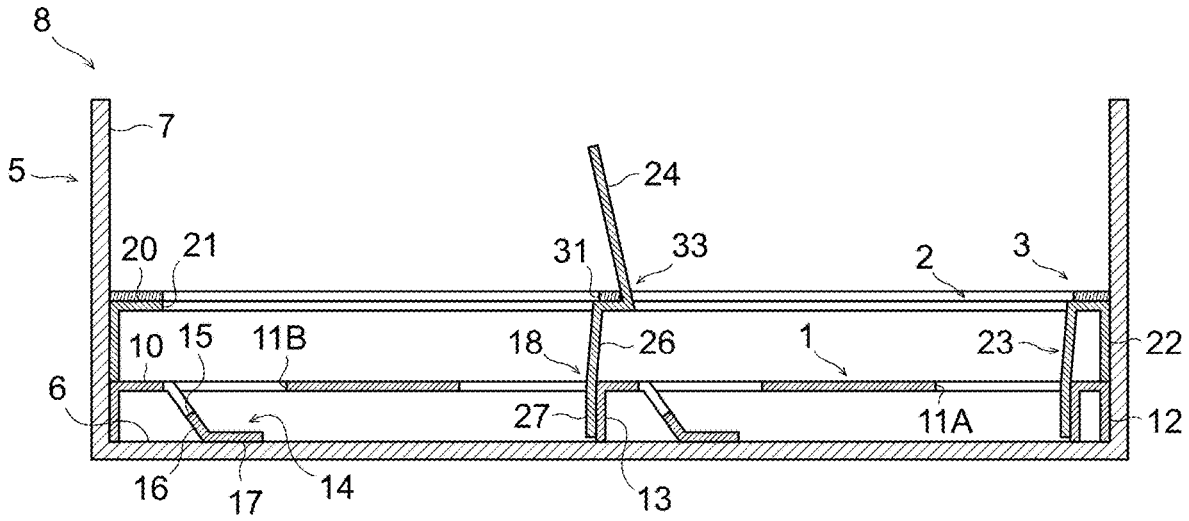
FIG. 6A is a cross-sectional view for explaining a packaging structure in a state where there is no component (motor)
Figure 6B:
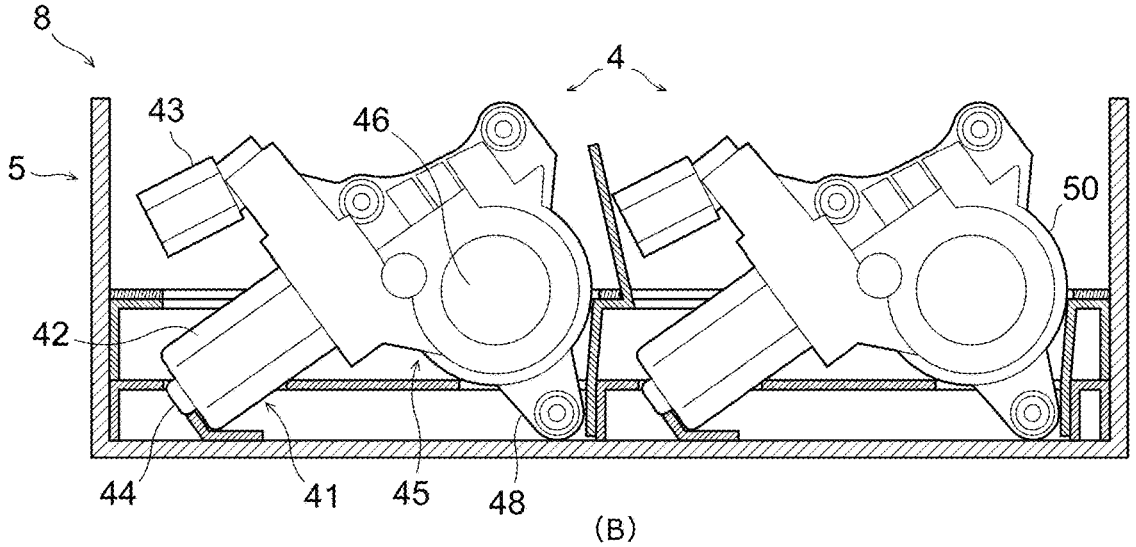
FIG. 6B is a cross-sectional view for explaining the packaging structure in a state where a component (motor) is supported.

The lower layer upper surface portion 10 is a portion forming an upper surface of the lower layer tray 1 in a state where the lower layer tray 1 is laid in the middle box 5. The lower layer upper surface portion 10 is formed in a rectangular shape having substantially the same size as the bottom surface 6 of the middle box 5, and is substantially parallel to the bottom surface 6 of the middle box 5. Furthermore, the lower layer opening 11 is a hole into which the motor 4 is inserted and fixed. As illustrated in FIGS. 5, 6A, and 6B, the lower layer opening 11 of the present embodiment includes a lower layer opening 11A into which the mounting foot 48 is inserted and a lower layer opening 11B into which the motor unit 41 is inserted.

Regarding a positional relationship between the lower layer opening 11A and the lower layer opening 11B corresponding to one motor 4, the lower layer opening 11A is located on the left side and the lower layer opening 11B is located on the right side in the odd-numbered line from the top in FIG. 2. On the other hand, in the even-numbered line, the lower layer opening 11A is located on the right side, and the lower layer opening 11B is located on the left side. The shape of each of the lower layer opening 11A and the lower layer opening 11B is set according to the shape of the motor 4, and may be integrally formed.

The lower layer leg 12 is four planar portions suspended downward from each of four outer peripheral sides surrounding the lower layer upper surface portion 10. The lower layer leg 12 is formed by folding the outer peripheral edge of the lower layer tray 1 downward. Heights of the lower layer legs 12 are substantially the same. Furthermore, the entire lower end of the lower layer leg 12 is in contact with (abuts on) the bottom surface 6. As a result, the lower layer upper surface portion 10 becomes substantially parallel to the bottom surface 6. Note that the height of the lower layer leg 12 corresponds to a vertical separation distance between the lower layer upper surface portion 10 and the bottom surface 6.

The lower layer first tab 13 is a portion provided at an edge of the lower layer opening 11A and folded downward. The lower layer first tab 13 is provided so as to be in contact with, for example, the bottom surface 6 of the middle box 5. The lower layer first tab 13 is preferably provided substantially perpendicular to the lower layer upper surface portion 10. As illustrated in FIG. 2, an opening area of the lower layer opening 11A before the lower layer first tab 13 is folded downward is narrowed by the size of the lower layer first tab 13. On the other hand, as illustrated in FIG. 5, by folding the lower layer first tab 13 downward, the opening area of the lower layer opening 11A is enlarged, and a sufficient size for inserting the mounting foot 48 is secured. At this time, an end side of the lower layer opening 11A formed by the folded lower layer first tab 13 becomes the lower layer locking portion 18 to which a middle layer first tab 23 described later is locked. Here, a width dimension (dimension in the vertical direction in FIG. 2) of the lower layer locking portion 18 is $W_1$.

The lower layer second tab 14 is provided at an edge of the lower layer opening 11B, and is a portion folded downward and brought into contact with the bottom surface 6 of the middle box 5. As illustrated in FIG. 2, the lower layer opening 11B is not formed before the lower layer second tab 14 is folded downward. On the other hand, as illustrated in FIG. 5, by folding the lower layer second tab 14 downward, the entire lower layer opening 11B appears, and a sufficient size for inserting the motor unit 41 is secured. Note that the lower layer second tab 14 illustrated in FIG. 5 is formed in a shape folded downward in a crank shape.

The lower layer second tab 14 of the present embodiment includes the lower layer longitudinal portion 16 and the lower layer lateral portion 17. The lower layer longitudinal portion 16 is a planar portion extending downward from the lower layer upper surface portion 10, and the lower layer lateral portion 17 is a planar portion in contact with the bottom surface 6 and extending substantially horizontally along the bottom surface 6. By providing the lower layer longitudinal portion 16 and the lower layer lateral portion 17, the lower side and the lateral side of the motor unit 41 are simultaneously covered (covered) by the lower layer second tab 14. Note that the lower layer longitudinal portion 16 may be perpendicular to the lower layer upper surface portion 10 or may be inclined with respect to the lower layer upper surface portion 10. The surface gradient of the lower layer longitudinal portion 16 may be appropriately set according to the shape of the motor housing 42 in contact with the lower layer longitudinal portion 16.

The lower layer holding hole 15 is a hole drilled at least in the lower layer longitudinal portion 16 of the lower layer second tab 14, and is a portion into which the protrusion 44 is inserted when the motor unit 41 is inserted into the lower layer opening 11B. As a result, the protrusion 44 is firmly supported with respect to the lower layer second tab 14, and the entire motor 4 is stably fixed. Furthermore, as illustrated in FIG. 5, the lower layer holding hole 15 of the present embodiment is formed in a shape protruding toward a side of the lower layer upper surface portion 10 from a boundary between the lower layer upper surface portion 10 and the lower layer longitudinal portion 16. This facilitates insertion of the protrusion 44 into the lower layer holding hole 15 when the motor 4 is to be inserted downward from above.

[B. Middle Layer Tray]

Figure 3:
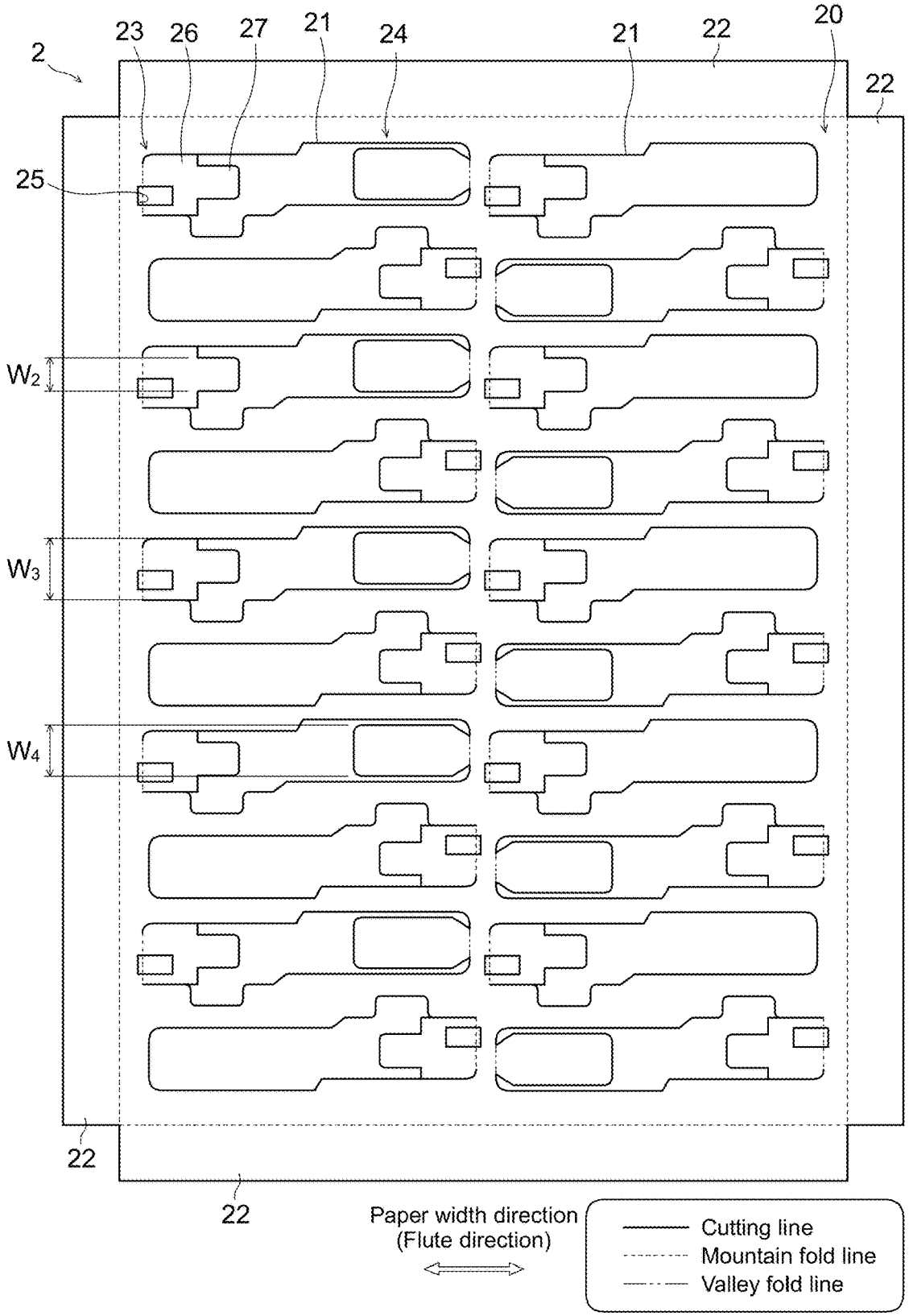
FIG. 3 is a developed view of a middle layer tray illustrated in FIG. 1.

The middle layer tray 2 is a tray-shaped member provided above the lower layer tray 1 inside the middle box 5. Similarly to the lower layer tray 1, the middle layer tray 2 of the present embodiment is laid so as to be substantially horizontal inside the middle box 5. Here, a developed view of the middle layer tray 2 is illustrated in FIG. 3. A solid line in FIG. 3 represents a cutting line. Furthermore, a broken line in FIG. 3 represents a mountain fold line when the middle layer tray 2 is viewed from above, and a two-dot chain line in FIG. 3 represents a valley fold line when the middle layer tray 2 is viewed from above. A paper width direction of the cardboard sheet constituting the middle layer tray 2 is the left-right direction in FIG. 3. The paper width direction of the middle layer tray 2 is the same as the paper width direction of the lower layer tray 1. Furthermore, an enlarged perspective view of a state in which the mountain fold line and the valley fold line are folded is illustrated in FIG. 5.

As illustrated in FIGS. 1, 3, and 5, the middle layer tray 2 is provided with a middle layer upper surface portion 20, a middle layer opening 21, a middle layer leg 22, a middle layer first tab 23, and a middle layer second tab 24. In the middle layer tray 2 illustrated in FIG. 3, the motors 4 are accommodated in an arrangement of two rows horizontally and ten lines vertically, and one middle layer opening 21, one middle layer first tab 23, and one middle layer second tab 24 are provided at positions where the motors 4 are accommodated. In other words, the middle layer openings 21 are arranged so as to be arranged in two rows in top view. In the middle layer opening 21, a cover portion release hole 25 is formed in a portion where the middle layer first tab 23 is folded. Furthermore, the middle layer first tab 23 is provided with a middle layer wall portion 26 and a middle layer insertion portion 27.

The middle layer upper surface portion 20 is a portion forming an upper surface of the middle layer tray 2 in a state where the middle layer tray 2 is laid in the middle box 5. The middle layer upper surface portion 20 is formed in a rectangular shape having substantially the same size as the bottom surface 6 of the middle box 5 and the lower layer upper surface portion 10, and is substantially parallel to the lower layer upper surface portion 10. Furthermore, the middle layer opening 21 is a hole into which the motor 4 is inserted and fixed. The shape of the middle layer opening 21 is set according to the shape of the motor 4. The motor housing 42 and the decelerator case 46 are inserted into the middle layer opening 21 of the present embodiment. However, the middle layer opening 21 is not in contact with the packing 49 of the motor 4. As a result, wear and deformation of the packing 49 are suppressed, and a maintenance state of the motor 4 is improved.

The middle layer leg 22 is four planar portions suspended downward from each of four outer peripheral sides surrounding the middle layer upper surface portion 20. The middle layer leg 22 is formed by folding the outer peripheral edge of the middle layer tray 2 downward. Heights of the middle layer legs 22 are substantially the same. Furthermore, the entire lower end side of the middle layer leg 22 is in contact with (abuts on) the lower layer upper surface portion 10. As a result, the middle layer upper surface portion 20 becomes substantially parallel to the lower layer upper surface portion 10. Note that the height of the middle layer leg 22 corresponds to a vertical separation distance between the middle layer upper surface portion 20 and the lower layer upper surface portion 10.

The middle layer first tab 23 is a portion that is provided at the edge of the middle layer opening 21, is folded downward, and is engaged with the lower layer opening 11 in a state of overlapping the lower layer first tab 13. Similarly to the lower layer first tab 13, the middle layer first tab 23 is preferably provided substantially perpendicular to the middle layer upper surface portion 20. In the middle layer tray 2 illustrated in FIG. 3, the middle layer first tabs 23 are provided one by one (at 20 locations in total) in all the middle layer openings 21. The middle layer first tab 23 is provided on one end side (In FIG. 3, the odd-numbered line from the top is the left end of each middle layer opening 21, and the even-numbered line is the right end of each middle layer opening 21.) of the middle layer opening 21.

The middle layer second tab 24 is provided at a position different from the middle layer first tab 23 in the edge of the middle layer opening 21, and is a portion folded upward. The middle layer second tab 24 is preferably folded to a state of being perpendicular to the middle layer upper surface portion 20 or a state of being further rotated than perpendicular. The middle layer second tab 24 is a portion to be engaged with an upper layer locking portion 33 described later.

In the middle layer tray 2 illustrated in FIG. 3, the middle layer second tabs 24 are not provided in all the middle layer openings 21, but are provided between the middle layer openings 21 arranged in a plurality of rows. For example, it is provided only on the center side of the middle layer openings 21 arranged in two rows. That is, the middle layer second tab 24 is provided only at a position on the center side of the two rows among the other end sides (In FIG. 3, in the odd-numbered line from the top, the middle layer second tab is provided at the right end portion of the middle layer opening 21, and in the even-numbered line, the middle layer second tab is provided at the left end portion of the middle layer opening 21.) of each middle layer opening 21. In other words, the middle layer second tab 24 is provided only at the right end portion of the left middle layer opening 21 of the middle layer openings 21 of the two rows in the odd-numbered line when counted from the top in FIG. 3, and is provided only at the left end portion of the right middle layer opening 21 of the middle layer openings 21 of the two rows in the even-numbered line. Therefore, the middle layer second tabs 24 are provided at ten places in total.

As illustrated in FIG. 3, an opening area of the middle layer opening 21 before the middle layer first tab 23 and the middle layer second tab 24 are folded is narrowed by the size of the middle layer first tab 23 and the middle layer second tab 24. On the other hand, as illustrated in FIG. 5, by folding the middle layer first tab 23 downward and folding the middle layer second tab 24 upward, the opening area of the middle layer opening 21 is enlarged, and a sufficient size for inserting the motor housing 42 and the decelerator case 46 is secured.

The middle layer first tab 23 of the present embodiment includes the middle layer wall portion 26 and the middle layer insertion portion 27. The middle layer wall portion 26 is a portion of the middle layer first tab 23 on a side of a base end portion (that is, an upper side) of the folding, and the middle layer insertion portion 27 is a portion on a side of a tip end portion (that is, a lower side) of the folding. Here, a width dimension (dimension in the vertical direction in FIG. 3) of the middle layer insertion portion 27 is $W_2$, and a width dimension (dimension in the vertical direction in FIG. 3) of the middle layer wall portion 26 is $W_3$. Furthermore, a width dimension (dimension in the vertical direction in FIG. 3) of the middle layer second tab 24 is $W_4$.

The width dimension $W_2$ of the middle layer insertion portion 27 is substantially the same as the width dimension $W_1$ of the lower layer locking portion 18, and the middle layer insertion portion 27 can be inserted into and locked to the inner side of the lower layer locking portion 18. Furthermore, the width dimension $W_3$ of the middle layer wall portion 26 is set to be larger than the width dimension $W_2$ of the middle layer insertion portion 27 ($W_1 \approx W_2 < W_3$). As a result, the lower end surface of the middle layer wall portion 26 forming a step between the middle layer wall portion 26 and the middle layer insertion portion 27 can be brought into surface contact with the lower layer upper surface portion 10.

Note that the lower end (tip) of the middle layer insertion portion 27 may be brought into contact with the bottom surface 6 of the middle box 5. As a result, not only the lower layer first tabs 13 but also the middle layer first tabs 23 come into contact with the bottom surface 6, and the shape stability of the middle layer tray 2 is improved. On the other hand, the lower end portion (tip) of the middle layer insertion portion 27 may be slightly separated from the bottom surface 6 of the middle box 5. Accordingly, buckling deformation of the middle layer first tabs 23 can be suppressed. In this case, the middle layer first tab 23 is not in contact with the bottom surface 6, but the load acting on the middle layer tray 2 is transmitted from the lower end surface of the middle layer wall portion 26 to the lower layer tray 1 and transmitted to the bottom surface 6 via the lower layer first tab 13. Therefore, even when the middle layer first tab 23 is not in contact with the bottom surface 6, the surface rigidity of the middle layer tray 2 is maintained.

The cover portion release hole 25 is a hole drilled at least in the middle layer wall portion 26 of the middle layer first tab 23, and is a portion into which the cover portion 50 of the outer surface of the decelerator case 46 is inserted when the motor 4 is inserted into the middle layer opening 21. The cover portion 50 is inserted (loosely inserted) into the cover portion release hole 25 in a non-contact state. As a result, a certain gap dimension is secured between the cover portion release hole 25 and the cover portion 50. Furthermore, as illustrated in FIG. 5, the cover portion release hole 25 of the present embodiment is formed in a shape protruding toward a side of the middle layer upper surface portion 20 from a boundary between the middle layer upper surface portion 20 and the middle layer wall portion 26. As a result, when the motor 4 is to be inserted downward from above, the cover portion 50 of the decelerator case 46 is easily inserted into the cover portion release hole 25.

[C. Upper Layer Tray]

Figure 4:
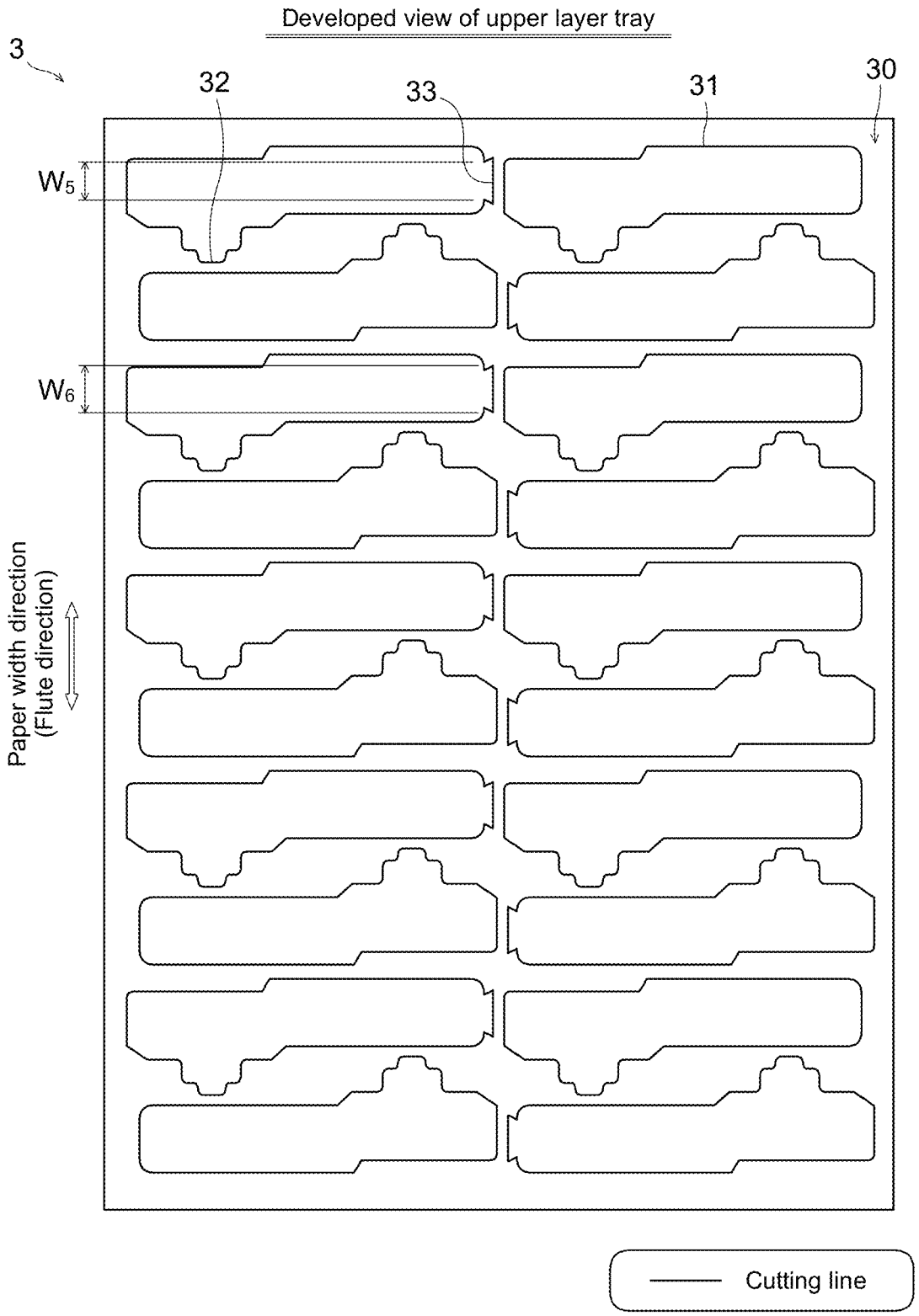
FIG. 4 is a developed view of an upper layer tray illustrated in FIG. 1.

The upper layer tray 3 is a planar member provided on the upper surface of the middle layer tray 2 inside the middle box 5. The upper layer tray 3 is directly placed on the middle layer tray 2 so as to be substantially in surface contact with the middle layer upper surface portion 20. Similarly to the lower layer tray 1 and the middle layer tray 2, the upper layer tray 3 of the present embodiment is laid so as to be substantially horizontal inside the middle box 5. Here, a developed view of the upper layer tray 3 is illustrated in FIG. 4. A solid line in FIG. 4 represents a cutting line. A paper width direction of the cardboard sheet constituting the upper layer tray 3 is a vertical direction in FIG. 4. The paper width direction of the upper layer tray 3 is orthogonal to the paper width direction of the lower layer tray 1 and the middle layer tray 2. Furthermore, FIG. 5 illustrates an enlarged perspective view of a main part of the upper layer tray 3.

As illustrated in FIGS. 1, 4, and 5, the upper layer tray 3 is provided with an upper layer upper surface portion 30, an upper layer opening 31, an upper layer abutting portion 32, and an upper layer locking portion 33. In the upper layer tray 3 illustrated in FIG. 4, the motors 4 are accommodated in an arrangement of two rows horizontally and ten lines vertically, and one upper layer opening 31 is provided at a position where each motor 4 is accommodated. In other words, the upper layer openings 31 are arranged in two rows in top view.

The upper layer upper surface portion 30 is a portion forming an upper surface of the upper layer tray 3 in a state where the upper layer tray 3 is laid in the middle box 5. The upper layer upper surface portion 30 is formed in a rectangular shape having substantially the same size as the lower layer upper surface portion 10 and the middle layer upper surface portion 20. Furthermore, the upper layer opening 31 is a hole into which the motor 4 is inserted and fixed. The shape of the upper layer opening 31 is set according to the shape of the motor 4. The motor housing 42 and the decelerator case 46 are inserted into the upper layer opening 31 of the present embodiment. However, the upper layer opening 31 is not in contact with the packing 49 of the motor 4. As a result, wear and deformation of the packing 49 are suppressed, and a maintenance state of the motor 4 is improved.

The upper layer abutting portion 32 is a portion that abuts on a tip of the output shaft 47 when the motor 4 is inserted into the upper layer opening 31, and is provided at the edge of the upper layer opening 31. As a result, movement of the output shaft 47 and contact between the adjacent motors 4 due to vibration during conveyance are suppressed, and the maintenance state of the motor 4 is improved.

The upper layer locking portion 33 is a portion formed in a wedge shape at the edge of the upper layer opening 31. As illustrated in FIGS. 4 and 5, the upper layer locking portion 33 is formed in a trapezoidal shape (reverse tapered shape) so as to enlarge the upper layer opening 31 outward. Here, a width dimension (dimension in the vertical direction in FIG. 4) of a boundary portion between the upper layer opening 31 and the upper layer locking portion 33 is $W_5$, and a maximum width dimension (dimension in the vertical direction in FIG. 4) of the upper layer locking portion 33 is $W_6$.

The upper layer locking portion 33 is formed in a shape in which the width dimension $W_5$ of the boundary portion between the upper layer opening 31 and the upper layer locking portion 33 is narrower than a width dimension (for example, the maximum width dimension $W_6$ of the upper layer locking portion 33) of other portions of the upper layer locking portion 33. Furthermore, the width dimension $W_5$ of the boundary portion between the upper layer opening 31 and the upper layer locking portion 33 is set to a dimension narrower than the width dimension $W_4$ of the middle layer second tab 24, and the maximum width dimension $W_6$ of the upper layer locking portion 33 is set to a dimension wider than the width dimension $W_4$ of the middle layer second tab 24 ($W_5<W_4<W_6$). As a result, the middle layer second tab 24 can be inserted into and locked to the upper layer locking portion 33.

In the upper layer tray 3 illustrated in FIG. 4, the upper layer locking portions 33 are not provided in all the upper layer openings 31, and are provided only on a center side of the upper layer openings 31 arranged in two rows. In other words, the upper layer locking portion 33 is provided only at the right end portion of the upper layer opening 31 on the left side among the upper layer openings 31 in the two rows in the odd-numbered line when counted from the top in FIG. 4, and is provided only at the left end portion of the upper layer opening 31 on the right side among the upper layer openings 31 in the two rows in the even-numbered line. Therefore, the upper layer locking portions 33 are provided at ten places in total.

2. Accommodating State

FIG. 6A is a cross-sectional view for explaining the packaging structure 8 in a state where the motor 4 is not accommodated. In the lower layer tray 1, the lower end of the lower layer leg 12 (the entire periphery of the lower layer tray 1), the lower end of the lower layer first tab 13, and the lower layer lateral portion 17 of the lower layer second tab 14 are in contact with the bottom surface 6 of the middle box 5. In the middle layer tray 2, the lower end of the middle layer leg 22 (the entire circumference of the middle layer tray 2) is in contact with the lower layer upper surface portion 10, the middle layer first tab 23 is locked to the lower layer locking portion 18, and the middle layer second tab 24 is locked to the upper layer locking portion 33. Since the upper layer tray 3 is laid on the upper surface of the middle layer tray 2, the upper layer tray 3 entirely contacts the middle layer upper surface portion 20.

FIG. 6B is a cross-sectional view for explaining the packaging structure 8 in a state where the motor 4 is accommodated. The decelerator unit 45 is inserted into the lower layer opening 11A from above, and is stably held by the lower layer first tab 13 and the middle layer first tab 23. At this time, the lower layer first tab 13 and the middle layer first tab 23 function to partition an accommodation space of the right motor 4 and an accommodation space of the left motor 4 illustrated in FIG. 6B. This prevents the left and right motors 4 from coming into contact with each other (for example, contact between the decelerator unit 45 of the left motor 4 and the motor unit 41 of the right motor 4).

The motor unit 41 is inserted into the lower layer opening 11B from above and is supported by the lower layer second tab 14. At this time, the protrusion 44 of the motor 4 is inserted into the lower layer holding hole 15 and stably held by the lower layer longitudinal portion 16 of the lower layer second tab 14. Furthermore, the cover portion 50 of the decelerator unit 45 is inserted into the cover portion release hole 25 in a non-contact state, and a certain gap dimension is secured between the cover portion release hole 25 and the cover portion 50. Furthermore, similarly to the lower layer first tab 13 and the middle layer first tab 23, the middle layer second tab 24 functions to partition the left and right accommodation spaces. This prevents the left and right motors 4 from coming into contact with each other (for example, contact between the decelerator unit 45 of the left motor 4 and the connector portion 43 of the right motor 4).

Figure 7:
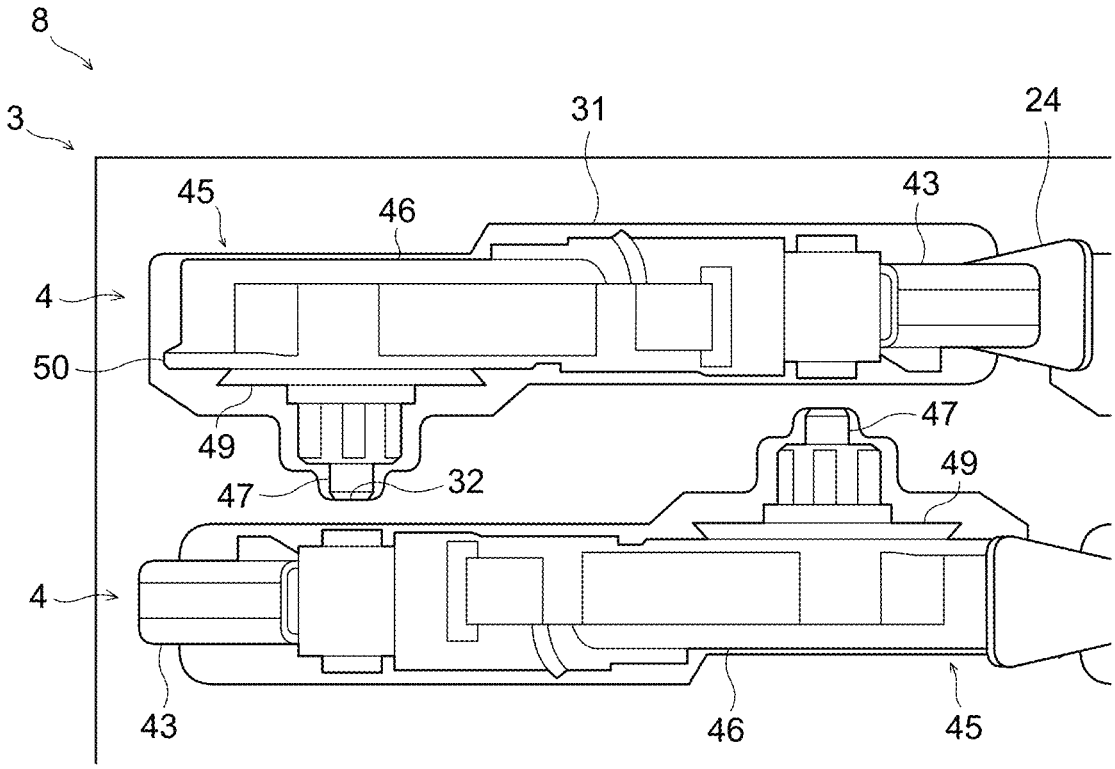
FIG. 7 is a top view for explaining a packaging structure in a state in which a component (motor) is supported.

FIG. 7 is a top view for explaining the packaging structure 8 in a state where the motor 4 is accommodated. The tip of the output shaft 47 of the motor 4 abuts on the upper layer abutting portion 32 provided at the edge of the upper layer opening 31. As a result, rattling and movement of the motor 4 in the extending direction of the output shaft 47 (the vertical direction in FIG. 7) are suppressed, and the holding state of the motor 4 is stabilized. On the other hand, the middle layer opening 21 and the upper layer opening 31 are not in contact with the packing 49 existing around the output shaft 47, and a certain gap dimension is secured. As a result, wear and deformation of the packing 49 are suppressed, and a maintenance state of the motor 4 is improved.

3. Effects (1) The packaging structure 8 according to the above embodiment includes the middle box 5 in which the motor 4 is accommodated, the lower layer tray 1 formed of a cardboard sheet and provided inside the middle box 5, and the middle layer tray 2 formed of a cardboard sheet and provided above the lower layer tray 1 inside the middle box 5. The lower layer tray 1 includes the lower layer opening 11 into which the motor 4 is inserted and fixed, and the lower layer first tab 13 provided at an edge of the lower layer opening 11 and folded downward. The middle layer tray 2 includes the middle layer opening 21 into which the motor 4 is inserted and fixed, and the middle layer first tab 23 provided at an edge of the middle layer opening 21, folded downward, and engaged with the lower layer opening 11 in a state of overlapping the lower layer first tab 13.

With such a configuration, the lower layer tray 1 and the middle layer tray 2 can be firmly coupled, the rigidity and strength of the packaging structure 8 can be improved with a simple configuration, and the protection for the motor 4 accommodated in the middle box 5 can be secured. Furthermore, the work for coupling the lower layer tray 1 and the middle layer tray 2 is easy, and workability related to packaging can be enhanced. In particular, as compared with the conventional vertical partition structure as described in, for example, JP-B2-2913259, it is not necessary to engage the slits of the plurality of corrugated cardboard plates with each other and combine them in a grid pattern, and workability related to packaging of the motor 4 and assembly of the packaging structure 8 can be significantly improved. Furthermore, as compared with the conventional vertical partition structure, a use amount of the cardboard sheet can be reduced, and a good cost reduction effect can be obtained.

Furthermore, by overlapping the middle layer first tab 23 and the lower layer first tab 13, they can function as a sturdy wall that supports the mounting foot 48 of the motor 4. Therefore, for example, in FIG. 6B, the motor 4 can be reliably suppressed from shaking or moving in the left-right direction, and the motor 4 can be stably fixed. Furthermore, the lower layer first tab 13 and the middle layer first tab 23 function to partition the accommodation space of the right motor 4 and the accommodation space of the left motor 4 illustrated in FIG. 6B. As a result, it is possible to prevent the left and right motors 4 from coming into contact with each other (for example, contact between the decelerator unit 45 of the left motor 4 and the motor unit 41 of the right motor 4), and to prevent the occurrence of deformation and scratches.

Moreover, for example, by bringing the lower layer first tab 13 and the middle layer first tab 23 into contact with the bottom surface 6 of the middle box 5, the lower layer tray 1 and the middle layer tray 2 can be supported by the lower layer first tab 13 with respect to the bottom surface 6. As a result, the surface rigidity of the lower layer tray 1 and the middle layer tray 2 can be improved, and downward deflection deformation can be suppressed. For example, in the lower layer tray 1 and the middle layer tray 2 illustrated in FIGS. 6A and 6B, it is possible to prevent the vicinity of the central portion in the left-right direction from slackening downward. Therefore, the stability retention and the protection of the motor 4 can be improved.

(2) In the packaging structure 8 described above, the lower layer tray 1 includes the lower layer leg 12 that is formed by folding the outer peripheral edge of the lower layer tray 1 downward and is in contact with the bottom surface 6, and the middle layer tray 2 includes the middle layer leg 22 that is formed by folding the outer peripheral edge of the middle layer tray 2 downward and is in contact with the lower layer tray 1.

With such a configuration, the separation distance between the bottom surface 6 and the lower layer tray 1 can be secured, and the separation distance between the lower layer tray 1 and the middle layer tray 2 can be secured. That is, as illustrated in FIG. 6A, the motor 4 can be fixed at two different positions in the height direction, and the stability retention and the protection of the motor 4 can be improved.

(3) The motor 4 is the motor 4 including the protrusion 44. Furthermore, in the packaging structure 8, the lower layer tray 1 includes the lower layer second tab 14 folded downward and brought into contact with the bottom surface 6 of the middle box 5, and the lower layer holding hole 15 drilled in the surface of the lower layer second tab 14 and into which the protrusion 44 is inserted.

With such a configuration, for example, as illustrated in FIGS. 5 and 6B, the motor unit 41 having a relatively large weight can be supported from four directions (from the front, rear, left, and right of the motor 4 in top view), and the stability retention and the protection of the motor 4 can be improved. Furthermore, the protrusion 44 can be firmly supported with respect to the lower layer second tab 14, and rattling and movement of the motor unit 41 can be suppressed. Moreover, by bringing the lower layer second tab 14 into contact with the bottom surface 6 of the middle box 5, the surface rigidity of the lower layer tray 1 can be further improved. Therefore, the stability retention and the protection of the motor 4 can be improved.

(4) For example, as illustrated in FIGS. 5 and 6A, the lower layer second tab 14 is formed in a shape folded downward in a crank shape. As a result, the holding height of the motor housing 42 can be adjusted, and the stability retention and the protection of the motor 4 can be improved.

(5) The motor 4 is the motor 4 including the output shaft 47. Furthermore, the packaging structure 8 further includes the upper layer tray 3 formed of a cardboard sheet and provided on the upper surface of the middle layer tray 2 inside the middle box 5. The upper layer tray 3 includes the upper layer opening 31 into which the motor 4 is inserted and fixed, and the upper layer abutting portion 32 provided at an edge of the upper layer opening 31 and abutting on a tip of the output shaft 47.

As described above, by coupling the lower layer tray 1, the middle layer tray 2, and the upper layer tray 3 to each other, it is possible to realize the three-dimensional packaging structure 8 that supports the motor 4 in the vertical direction, the left-right direction, and the front-rear direction, and to improve the stability retention and the protection of the motor 4. Furthermore, when the motor 4 is conveyed, the movement of the output shaft 47 and the contact between the adjacent motors 4 due to the vibration can be suppressed, and the rattling of the motor 4 in the extending direction of the output shaft 47 can be suppressed, so that the maintenance state of the motor 4 can be improved. Furthermore, the upper layer tray 3 can reinforce the middle layer tray 2. Therefore, the stability retention and the protection of the motor 4 can be improved.

(6) In the packaging structure 8 described above, the upper layer tray 3 includes the upper layer locking portion 33 formed in a wedge shape at the edge of the upper layer opening 31, and the middle layer tray 2 includes the middle layer second tab 24 provided at the edge of the middle layer opening 21 and folded upward to engage with the upper layer locking portion 33.

With such a configuration, the upper layer tray 3 and the middle layer tray 2 can be firmly coupled, the rigidity and strength of the packaging structure 8 can be improved with a simple configuration, and the protection for the motor 4 accommodated in the middle box 5 can be secured. Furthermore, as illustrated in FIG. 6B, the middle layer second tab 24 functions to partition the left and right accommodation spaces similarly to the lower layer first tab 13 and the middle layer first tab 23. As a result, it is possible to prevent the left and right motors 4 from coming into contact with each other (for example, contact between the decelerator unit 45 of the left motor 4 and the connector portion 43 of the right motor 4), and to prevent the occurrence of deformation and scratches.

(7) In the packaging structure 8, as illustrated in FIGS. 3 and 4, the upper layer opening 31 and the middle layer opening 21 are arranged in a plurality of rows (for example, two rows) in top view. Furthermore, the upper layer locking portion 33 and the middle layer second tab 24 are provided between the plurality of rows (for example, on the center side of the two rows) in top view. For example, in the odd-numbered line counting from the top in FIG. 3, the middle layer second tab 24 is provided only at the right end portion of the left middle layer opening 21 of the two rows of middle layer openings 21, and in the even-numbered line, the middle layer second tab 24 is provided only at the left end portion of the right middle layer opening 21 of the two rows of middle layer openings 21.

Similarly, in the odd-numbered line from the top in FIG. 4, the upper layer locking portion 33 is provided only at the right end portion of the upper layer opening 31 on the left side among the upper layer openings 31 of the two rows, and in the even-numbered line, the upper layer locking portion 33 is provided only at the left end portion of the upper layer opening 31 on the right side among the upper layer openings 31 of the two rows.

With such a configuration, it is possible to reliably prevent interference between the motors 4 arranged in the plurality of rows in top view while simplifying the configuration as compared with the case where the upper layer locking portion 33 and the middle layer second tab 24 are provided in all the upper layer openings 31 and the middle layer openings 21. Therefore, with a simple configuration, the workability of the packaging work can be enhanced while securing the protection for the motor 4.

(8) In the packaging structure 8 described above, the middle layer tray 2 and the lower layer tray 1 are laid inside the middle box 5 such that the paper width directions of the middle layer tray 2 and the lower layer tray 1 are parallel to each other. On the other hand, the upper layer tray 3 is laid inside the middle box 5 such that the paper width direction of the upper layer tray 3 is orthogonal to the paper width directions of the middle layer tray 2 and the lower layer tray 1.

As described above, by aligning the paper width directions of the middle layer tray 2 and the lower layer tray 1, the deformation amounts of the middle layer tray 2 and the lower layer tray 1 with respect to the external force can be aligned, and the followability of the motor 4 to the deformation can be improved. Therefore, the protection of the motor 4 can be improved. Furthermore, by making the paper width directions of the middle layer tray 2 and the lower layer tray 1 orthogonal to the paper width direction of the upper layer tray 3, the rigidity of the entire middle layer tray 2 and the lower layer tray 1 can be enhanced, and the stability retention and the protection of the motor 4 can be improved.

4. Others

The above embodiments are merely examples, and there is no intention to exclude the application of various modifications and techniques that are not explicitly described in the present embodiment. Each configuration of the present embodiment can be variously modified and implemented without departing from the spirit thereof. Furthermore, each configuration of the present embodiment can be selected as necessary, or can be appropriately combined with various configurations included in the known technology.

In the above embodiments, the packaging structure 8 including the lower layer tray 1, the middle layer tray 2, the upper layer tray 3, and the middle box 5 has been exemplified, but the upper layer tray 3 can be omitted. Furthermore, the lower layer leg 12 and the lower layer second tab 14 of the lower layer tray 1, the middle layer leg 22 and the middle layer second tab 24 of the middle layer tray 2, and the like can also be omitted. At least the lower layer opening 11 and the lower layer first tab 13 are formed in the lower layer tray 1, the middle layer opening 21 and the middle layer first tab 23 are formed in the middle layer tray 2, and the middle layer first tab 23 is engaged with the lower layer opening 11 in a state of overlapping the lower layer first tab 13, so that it is possible to realize the packaging structure 8 that exhibits the same effects as the above-described embodiment.

Figure 8:
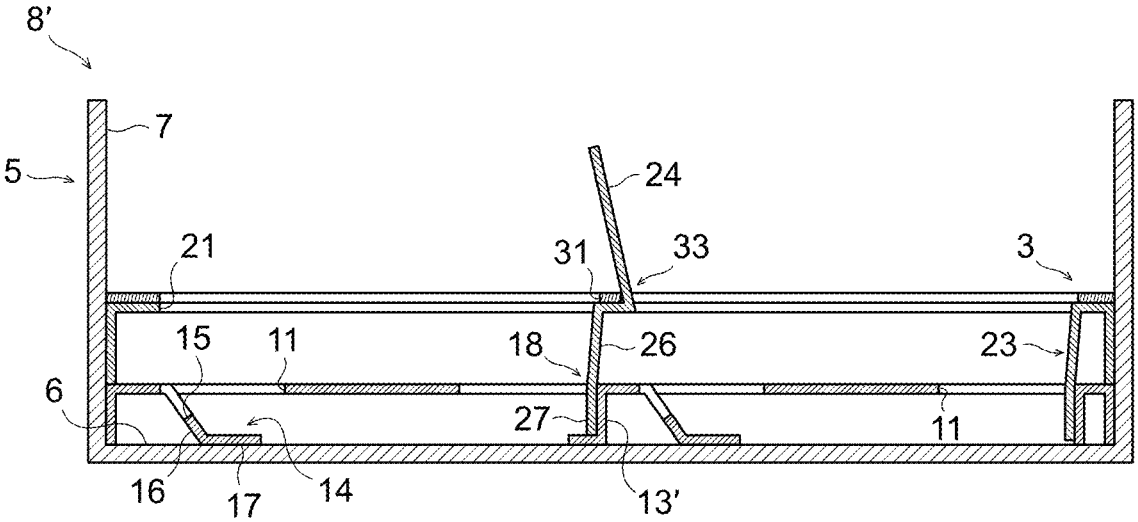
FIG. 8 is a cross-sectional view for explaining a packaging structure as a modification example.

FIG. 8 is a cross-sectional view for explaining a packaging structure 8' as a modification example. In FIG. 8, elements corresponding to the above-described embodiments are denoted by the same reference signs. In the packaging structure 8', a lower layer first tab 13' is provided at an edge of the lower layer opening 11 of the lower layer tray 1. The lower layer first tab 13' is a portion folded downward and brought into contact with the bottom surface 6 of the middle box 5. A lower end portion (tip side) of the lower layer first tab 13' is bent so as to extend substantially horizontally along the bottom surface 6, similarly to the lower layer lateral portion 17 of the lower layer second tab 14.

With such a configuration, a contact area between the lower layer first tab 13' and the bottom surface 6 can be increased. Therefore, the load acting on the lower layer tray 1 is reliably transmitted to the bottom surface 6 via the lower layer first tab 13', and the shape stability and surface rigidity of the lower layer tray 1 can be enhanced. In addition, when the lower end portion (tip) of the middle layer insertion portion 27 is brought into contact with a bent portion of the lower layer first tab 13', the shape stability and the surface rigidity of the middle layer tray 2 can also be enhanced.

Note that it is also possible to add an opening or a tab to each of the trays 1 to 3 of the above embodiments and modification example. For example, an upper layer tab may be added to the edge of upper layer opening 31. The upper layer tab is formed so as to be folded downward and engage with the middle layer opening 21 and the lower layer opening 11. With such a configuration, the robustness of the packaging structure 8 can be improved, and the stability retention and the protection of the motor 4 can be further improved with a simple configuration.

The lower layer tray 1 may be provided so as to also serve as the bottom surface 6 of the middle box 5. That is, instead of preparing the lower layer tray 1 separate from the middle box 5, the lower layer opening 11, the lower layer holding hole 15, and the like may be provided on the bottom surface 6 of the middle box 5. In this manner, by providing the bottom surface 6 of the middle box 5 with a function as the lower layer tray 1, it is possible to reduce the weight of the entire packaging and the use amount of the cardboard sheet, improve the efficiency of the transportation operation, and further reduce the cost.

The present disclosure is applicable to a component manufacturing industry and a packaging material manufacturing industry for packaging components.

DESCRIPTION OF REFERENCE SIGNS

1 lower layer tray
2 middle layer tray
3 upper layer tray
4 motor
5 middle box
6 bottom surface
7 side surface
8, 8' packaging structure
10 lower layer upper surface portion
11, 11A, 11B lower layer opening
12 lower layer leg
13, 13' lower layer first tab
14 lower layer second tab
15 lower layer holding hole
16 lower layer longitudinal portion
17 lower layer lateral portion
18 lower layer locking portion
20 middle layer upper surface portion
21 middle layer opening
22 middle layer leg
23 middle layer first tab
24 middle layer second tab
25 cover portion release hole
26 middle layer wall portion
27 middle layer insertion portion
30 upper layer upper surface portion
31 upper layer opening
32 upper layer abutting portion
33 upper layer locking portion
41 motor unit
42 motor housing
43 connector portion
44 protrusion
45 decelerator unit
46 decelerator case
47 output shaft
48 mounting foot
49 packing
50 cover portion
$W_1$ to $W_6$ width dimension

What is claimed is:

1. A packaging structure comprising:
a box in which a component is accommodated;
a lower layer tray formed of a cardboard sheet and provided inside the box; and
a middle layer tray formed of a cardboard sheet and provided above the lower layer tray inside the box, wherein
the lower layer tray includes a lower layer opening into which the component is inserted and fixed, and a lower layer first tab provided at an edge of the lower layer opening and folded downward, and
the middle layer tray includes a middle layer opening into which the component is inserted and fixed, and a middle layer first tab provided at an edge of the middle layer opening, folded downward, and engaged with the lower layer opening in a state of overlapping the lower layer first tab.

2. The packaging structure according to claim 1, wherein
the lower layer tray includes a lower leg configured to fold an outer peripheral edge of the lower layer tray downward and in contact with a bottom surface of the box, and
the middle layer tray includes a middle layer leg configured to fold an outer peripheral edge of the middle layer tray downward and in contact with the lower layer tray.

3. The packaging structure according to claim 2, wherein
the component is a motor including a protrusion, and
the lower layer tray includes a lower layer second tab folded downward and in contact with the bottom surface, and a lower layer holding hole drilled in a surface of the lower layer second tab and into which the protrusion is inserted.

4. The packaging structure according to claim 3, wherein
the lower layer second tab is folded downward into a crank shape.

5. The packaging structure according to claim 1, wherein
the component is a motor including a protrusion, and
the lower layer tray includes a lower layer second tab folded downward and in contact with a bottom surface of the box, and a lower layer holding hole drilled in a surface of the lower layer second tab and into which the protrusion is inserted.

6. The packaging structure according to claim 5, wherein
the lower layer second tab is folded downward into a crank shape.

7. The packaging structure according to claim 1, further comprising
an upper layer tray formed of a cardboard sheet and laid on an upper surface of the middle layer tray inside the box, wherein
the component is a motor including an output shaft, and
the upper layer tray includes an upper layer opening into which the component is inserted and fixed, and an upper layer abutting portion provided at an edge of the upper layer opening and abutting on a tip of the output shaft.

8. The packaging structure according to claim 7, wherein
the upper layer tray includes an upper layer locking portion formed in a wedge shape at an edge of the upper layer opening, and
the middle layer tray includes a middle layer second tab provided at an edge of the middle layer opening, folded upward, and engaged with the upper layer locking portion.

9. The packaging structure according to claim 8, wherein
the middle layer tray and the lower layer tray are laid inside the box such that a flute direction of the cardboard sheet forming the middle layer tray is parallel to a flute direction of the cardboard sheet forming the lower layer tray, and the upper layer tray is laid inside the box such that a flute direction of the cardboard sheet forming the upper layer tray is orthogonal to paper width directions of the middle layer tray and the lower layer tray.

10. The packaging structure according to claim 8, wherein the upper layer opening and the middle layer opening are arranged in a plurality of rows in top view, and the upper layer locking portion and the middle layer second tab are provided between the plurality of rows in top view.

11. The packaging structure according to claim 10, wherein the middle layer tray and the lower layer tray are laid inside the box such that a flute direction of the cardboard sheet forming the middle layer tray is parallel to a flute direction of the cardboard sheet forming the lower layer tray, and the upper layer tray is laid inside the box such that a flute direction of the cardboard sheet forming the upper layer tray is orthogonal to paper width directions of the middle layer tray and the lower layer tray.

12. The packaging structure according to claim 7, wherein the middle layer tray and the lower layer tray are laid inside the box such that a flute direction of the cardboard sheet forming the middle layer tray is parallel to a flute direction of the cardboard sheet forming the lower layer tray, and the upper layer tray is laid inside the box such that a flute direction of the cardboard sheet forming the upper layer tray is orthogonal to paper width directions of the middle layer tray and the lower layer tray.

13. The packaging structure according to claim 1, further comprising an upper layer tray formed of a cardboard sheet and provided on an upper surface of the middle layer tray inside the box, wherein the upper layer tray includes an upper layer opening into which the component is inserted and fixed, and an upper layer locking portion formed in a wedge shape at an edge of the upper layer opening, and the middle layer tray includes a middle layer second tab provided at an edge of the middle layer opening, folded upward, and engaged with the upper layer locking portion.

14. The packaging structure according to claim 13, wherein the middle layer tray and the lower layer tray are laid inside the box such that a flute direction of the cardboard sheet forming the middle layer tray is parallel to a flute direction of the cardboard sheet forming the lower layer tray, and the upper layer tray is laid inside the box such that a flute direction of the cardboard sheet forming the upper layer tray is orthogonal to paper width directions of the middle layer tray and the lower layer tray.

15. The packaging structure according to claim 13, wherein the upper layer opening and the middle layer opening are arranged in a plurality of rows in top view, and the upper layer locking portion and the middle layer second tab are provided between the plurality of rows in top view.

16. The packaging structure according to claim 15, wherein the middle layer tray and the lower layer tray are laid inside the box such that a flute direction of the cardboard sheet forming the middle layer tray is parallel to a flute direction of the cardboard sheet forming the lower layer tray, and the upper layer tray is laid inside the box such that a flute direction of the cardboard sheet forming the upper layer tray is orthogonal to paper width directions of the middle layer tray and the lower layer tray.

17. The packaging structure according to claim 1, wherein the lower layer tray is provided to also serve as a bottom surface of the box.

* * * * *